US007586251B2

(12) United States Patent
Jung et al.

(10) Patent No.: US 7,586,251 B2
(45) Date of Patent: Sep. 8, 2009

(54) ELECTRON EMISSION DEVICE WITH DECREASED ELECTRODE RESISTANCE AND FABRICATION METHOD AND ELECTRON EMISSION DISPLAY

(75) Inventors: Kyu-Won Jung, Kyunggi-do (KR); Il-Hwan Kim, Kyunggi-do (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 589 days.

(21) Appl. No.: 11/087,773

(22) Filed: Mar. 24, 2005

(65) Prior Publication Data

US 2006/0055311 A1 Mar. 16, 2006

(30) Foreign Application Priority Data

Mar. 31, 2004 (KR) ..... 10-2004-0021938

(51) Int. Cl.

| | |
|---|---|
| ***H01J 1/46*** | (2006.01) |
| ***H01J 1/52*** | (2006.01) |
| ***H01J 17/04*** | (2006.01) |
| ***H01J 17/21*** | (2006.01) |
| ***H01J 19/40*** | (2006.01) |
| ***H01J 19/38*** | (2006.01) |
| ***H01J 21/10*** | (2006.01) |

(52) U.S. Cl. ..... 313/348; 313/346 R; 313/355; 313/491; 313/495; 445/24; 445/25; 445/38

(58) Field of Classification Search ..... 313/495–497, 313/306, 309–310, 346, 351, 355, 239–304, 313/348; 257/10; 445/20–25
See application file for complete search history.

(56) References Cited

U.S. PATENT DOCUMENTS

| | | | | |
|---|---|---|---|---|
| 5,696,385 | A * | 12/1997 | Song et al. | 257/10 |
| 5,763,997 | A * | 6/1998 | Kumar | 313/495 |
| 5,773,834 | A * | 6/1998 | Yamamoto et al. | 250/423 F |
| 6,774,548 | B2 * | 8/2004 | Fran et al. | 313/309 |
| 6,873,118 | B2 * | 3/2005 | Russ et al. | 315/169.3 |
| 6,900,066 | B2 * | 5/2005 | Toyota et al. | 438/20 |
| 6,917,147 | B2 * | 7/2005 | Dijon et al. | 313/310 |

(Continued)

FOREIGN PATENT DOCUMENTS

JP 2003-234062 8/2003

(Continued)

*Primary Examiner*—Sikha Roy
*Assistant Examiner*—Jose M Diaz
(74) *Attorney, Agent, or Firm*—Robert E. Bushnell, Esq.

(57) ABSTRACT

An electron emission device includes: a substrate; first and second electrodes insulated from each other and having a predetermined shape on the substrate, at least one of the first and second electrodes being formed with a fine mesh pattern; and an electron emission region formed on the substrate and connected to one of the first and second electrodes. Furthermore, an electron emission display includes: first and second substrate arranged opposite to each other; first and second electrodes insulated from each other and having a predetermined shape on the first substrate, at least one of the first and second electrodes being formed with a fine mesh pattern; an electron emission region formed on the first substrate and connected to one of the first and second electrodes; and an image displaying portion including an anode electrode and a fluorescent layer arranged on the second substrate.

20 Claims, 6 Drawing Sheets

U.S. PATENT DOCUMENTS

| | | | | |
|---|---|---|---|---|
| 7,053,544 | B2 * | 5/2006 | Kijima et al. | 313/495 |
| 7,166,482 | B2 * | 1/2007 | Toyota et al. | 438/20 |
| 7,221,080 | B2 * | 5/2007 | Lee et al. | 313/309 |
| 2001/0025962 | A1 * | 10/2001 | Nakamoto | 257/137 |
| 2002/0094494 | A1 * | 7/2002 | Chung et al. | 430/311 |
| 2003/0141495 | A1 * | 7/2003 | Lee et al. | 257/10 |
| 2004/0004429 | A1 * | 1/2004 | Oh et al. | 313/495 |
| 2005/0029924 | A1 * | 2/2005 | Okai et al. | 313/495 |
| 2005/0116600 | A1 * | 6/2005 | Chi et al. | 313/293 |
| 2005/0168128 | A1 * | 8/2005 | Kang | 313/495 |
| 2005/0231088 | A1 * | 10/2005 | Chen et al. | 313/303 |
| 2007/0001575 | A1 * | 1/2007 | Ryu et al. | 313/311 |

FOREIGN PATENT DOCUMENTS

| | | |
|---|---|---|
| KR | 1997-0051793 | 7/1997 |
| KR | 10-0212529 | 5/1999 |

* cited by examiner

ELECTRON EMISSION DEVICE WITH DECREASED ELECTRODE RESISTANCE AND FABRICATION METHOD AND ELECTRON EMISSION DISPLAY

CLAIM OF PRIORITY

This application makes reference to, incorporates the same herein, and claims all benefits accruing under 35 U.S.C. 119 from an application for CATHODE PLATE OF ELECTRON EMISSION DISPLAY AND METHOD FOR MANUFACTURING THE SAME earlier filed in the Korean Intellectual Property Office on 31 Mar. 2004, and there duly assigned Serial No. 2004-21938.

BACKGROUND OF THE INVENTION

1. Field of the Invention

The present invention relates to an electron emission device, its fabrication method, and an electron emission display including the electron emission device.

2. Discussion of Related Art

Generally, an electron emission device is classified as either a hot cathode type or a cold cathode type, wherein the hot cathode type and the cold cathode type employ a hot cathode and cold cathode as an electron emission source. A cold cathode type electron emission device comprises a structure, such as a Field Emitter Array (FEA), a Surface Conduction Emitter (SCE), a Metal Insulating Layer Metal (MIM), a Metal Insulating Layer Semiconductor (MIS), and a Ballistic Electron Surface Emitter (BSE).

The foregoing electron emission devices are employed for an electron emission display, backlighting, and a lithography electron beam. Among these, the electron emission display comprises an electron emission region provided with the electron emission device to emit electrons, and an image-displaying region in which the emitted electrons collide with a fluorescent material to emit light. Generally, the electron emission display comprises a plurality of electron emission devices formed on a first substrate; a driving electrode to control the electron emission of electron emission devices; a fluorescent layer formed on a second substrate and colliding with the electrons emitted by the first substrate; and a focusing electrode to accelerate the electrons towards the fluorescent layer.

In a triode electron emission display comprising a cathode electrode, an anode electrode and a gate electrode, a predetermined driving voltage is applied between the cathode electrode and the gate electrode, and a voltage difference therebetween creates an electric field, thereby causing an electron emission device to emit electrons and to accelerate the electrons towards a fluorescent layer. Such an electron emission display has a high brightness and a wide viewing angle like that of a Cathode Ray Tube (CRT) display.

In such an electron emission device, the electron emission region is formed on the cathode electrode by a thick film process or a thin film process. In a thick film process, a film material is squeezed out through a mesh aperture of a mesh mask by a squeezer or a rubber roller, thereby printing the electron emission region. In the thick film process, there are problems in that the electron emission region is not accurately aligned and the height of the printing pattern is irregular, thereby short circuiting the gate electrodes due to the reduced accuracy.

To solve the above-described problems, a method of fabricating an electron emission device is discussed in Korean Patent First Publication No. 2003-28244. Hereinbelow, a method of fabricating an electron emission device will be described by way of example.

This method applies an exposure technology to the thick film method, so that the electron emission regions can have regular height without the thin film method.

In a method of fabricating an electron emission device, a transparent Indium Tin Oxide (ITO) electrode is formed on a substrate. A stripe electrode having a constant conductivity is formed in the transparent electrode. Then, a dielectric layer is formed on the substrate having the stripe electrode. Then, a gate electrode is formed on the dielectric layer. Thereafter, an aperture formed on the substrate by the transparent electrode, the stripe electrode and the dielectric layer is filled with a photosensitive material, e.g., a Carbon Nano Tube (CNT) paste, and then processed by a rear exposure process. After the rear exposure, the photosensitive material is developed and dried, thereby forming an electron emission region.

The rear exposure process is used in the method of fabricating the electron emission device noted above, so that the ITO electrode is employed. However, the electrode resistance of the ITO electrode is relatively high, for instance, the electrode resistance of the ITO electrode is about 100KO in the case of the electron emission device of 38 inches. Therefore, in such an electron emission device having the top-gate structure, a relatively high voltage must be supplied to the cathode electrode employed as the data electrode. To supply the high voltage to the cathode electrode, the cross section of the cathode electrode must be large. As the cross section of the cathode electrode becomes larger, the breakdown voltage of the dielectric layer must be increased, and therefore the thickness of the dielectric layer must also be increased. In addition to the problem, the higher the voltage supplied to the cathode electrode, the more power the electron emission display consumes.

Furthermore, the rear exposure process is used in the method of fabricating the cathode substrate of the electron emission display, so that an expensive glass substrate such as a PD200 ITO glass must be employed. Since the expensive glass substrate must be employed, there arises a problem in that the production cost of the electron emission display is increased.

Korean Patent Publication Nos. 10-1997-0051793, 10-1997-0030078, and 2003-234062 each relate to methods of manufacturing field emission devices bearing features in common with the present invention. However, none of these references teach or suggest the all of the features of the present invention recited in the appended claims.

SUMMARY OF THE INVENTION

Accordingly, it is an aspect of the present invention to provide an electron emission device of an electron emission display, which decreases electrode resistance without using an ITO electrode.

Another aspect of the present invention is to provide an electron emission device of an electron emission display, which can employ an inexpensive glass substrate in lieu of an expensive optical transparent glass substrate.

Still another aspect of the present invention is to provide a method of fabricating an electron emission device of an electron emission display employing a thin metal film electrode instead of the ITO electrode.

These and other aspects of the present invention are achieved by providing an electron emission device comprising: a substrate; first and second electrodes insulated from each other and arranged on the substrate, at least one of the first and second electrodes having a fine mesh pattern; and an electron emission region connected to one of the first and second electrodes.

The fine mesh pattern transmits light therethrough and preferably comprises at least one of a plurality of apertures, a plurality of slits, and a combination thereof.

The fine mesh pattern is preferably arranged in correspondence with the electron emission region.

The thickness and the width of the fine mesh pattern are preferably in accordance with the resistance of the at least one of the first and second electrodes having the fine mesh pattern.

The electron emission device preferably further comprises a grid electrode adapted to focus electrons emitted by the electron emission region.

The electron emission region preferably comprises a nanotube including one of a Carbon Nano-Tube (CNT), a nanowire, Silicon (Si), Silicon Carbide (SiC), graphite, diamond, Diamond-Like Carbon (DLC), or a combination thereof.

These and other aspects of the present invention are also achieved by providing an electron emission display comprising: first and second substrates arranged opposite to each other; first and second electrodes arranged on the first substrate and insulated from each other, at least one of the first and second electrodes having a fine mesh pattern; an electron emission region connected to one of the first and second electrodes; and an image displaying portion including an anode electrode and a fluorescent layer arranged on the second substrate.

The fine mesh pattern transmits light therethrough and preferably comprises at least one of a plurality of apertures, a plurality of slits, and a combination thereof.

The fine mesh pattern is arranged in correspondence to the electron emission region.

The thickness and the width of the fine mesh pattern are preferably in accordance with the resistance of the at least one of the first and second electrodes having the fine mesh pattern.

The electron emission region preferably comprises a nanotube including one of a Carbon Nano-Tube (CNT), a nanowire, Silicon (Si), Silicon Carbide (SiC), graphite, diamond, Diamond-Like Carbon (DLC), or a combination thereof.

The electron emission display preferably further comprises a grid electrode adapted to focus electrons emitted by the electron emission region.

The electron emission display preferably further comprises an optical interception film arranged on an inner surface of the second substrate facing the first substrate.

The electron emission display preferably further comprises a metal reflecting film arranged on an inner surface of the second substrate facing the first substrate.

The electron emission display preferably further comprises a spacer adapted to support the first and second substrates to space them apart from each other.

These and other aspects of the present invention are further achieved by providing a method of fabricating an electron emission device, the method comprising: forming a first electrode on a transparent optical substrate, the first electrode having a fine mesh pattern; forming a dielectric layer having an aperture through which the fine mesh pattern is exposed, the dielectric layer covering the transparent optical substrate and the first electrode; forming a second electrode on the dielectric layer, the second electrode having an opening corresponding to the aperture; and forming an electron emission region within the aperture, the electron emission region being connected to the fine mesh pattern.

Forming the first electrode preferably comprises forming the fine mesh pattern to include at least one of a plurality of apertures, a plurality of slits, and a combination thereof, through which light is transmitted.

The first electrode preferably comprises a conductive metal selected from at least one of gold (Au), silver (Ag), platinum (Pt), aluminum (Al), chrome (Cr), and an alloy thereof.

Forming the electron emission region preferably comprises applying a carbon nano-tube paste to the substrate, processing the carbon nano-tube paste by rear exposure, and developing an unexposed portion of the carbon nano-tube paste.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF INVENTION

Figure 1A:
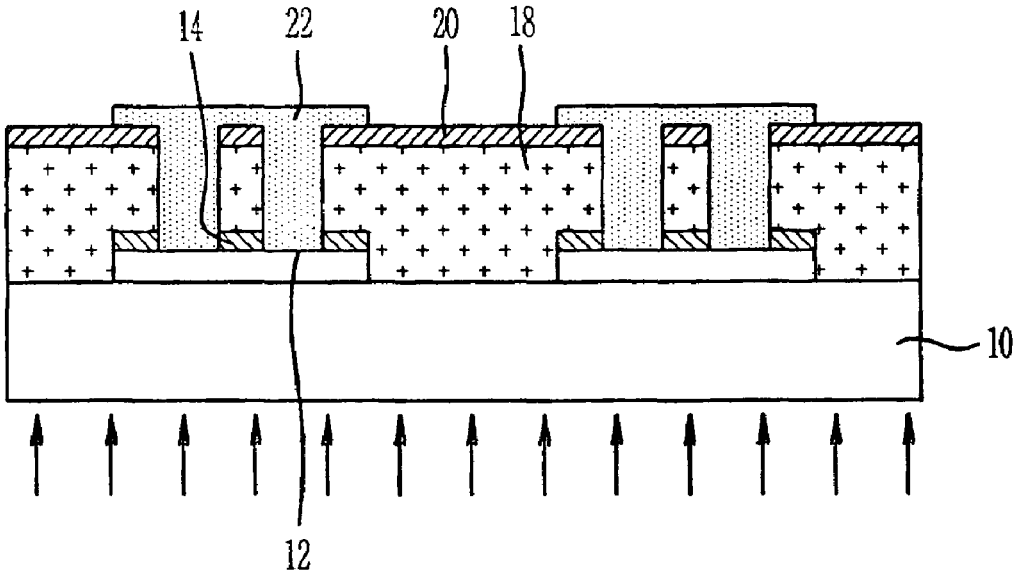
FIGS. 1A and 1B are sectional views of a method of fabricating an electron emission device.
Figure 1B:
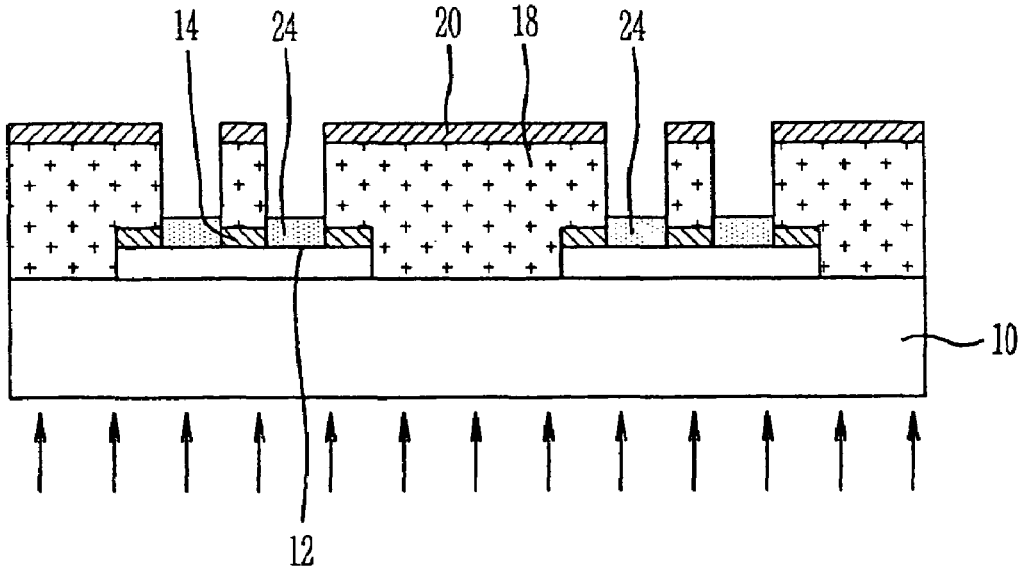

FIGS. 1A and 1B are sectional views of a method of fabricating an electron emission device.

Referring to FIGS. 1A and 1B, a transparent Indium Tin Oxide (ITO) electrode 12 is formed on a substrate 10. A stripe electrode 14 is formed In the transparent electrode 12 to have a constant conductivity. Then, a dielectric layer 18 is formed on the substrate 10 having the stripe electrode 14. Then, a gate electrode 20 is formed on the dielectric layer 18. Thereafter, an aperture formed by the transparent electrode 12, the stripe electrode 14 and the dielectric layer 18 on the substrate 10 is filled with a photosensitive material 22, e.g., a Carbon Nano Tube (CNT) paste, and then processed by a rear exposure process as depicted in FIG. 1A. After the rear exposure process, as shown in FIG. 1B, the photosensitive material 22 is developed and dried, thereby forming an electron emission region 24.

Exemplary embodiments according to the present invention are described in detail below with reference to the accompanying drawings. It is readily understood by those skilled in the art that modifications are apparent and that the present invention is not limited to the following embodiments disclosed herein.

Figure 2A:
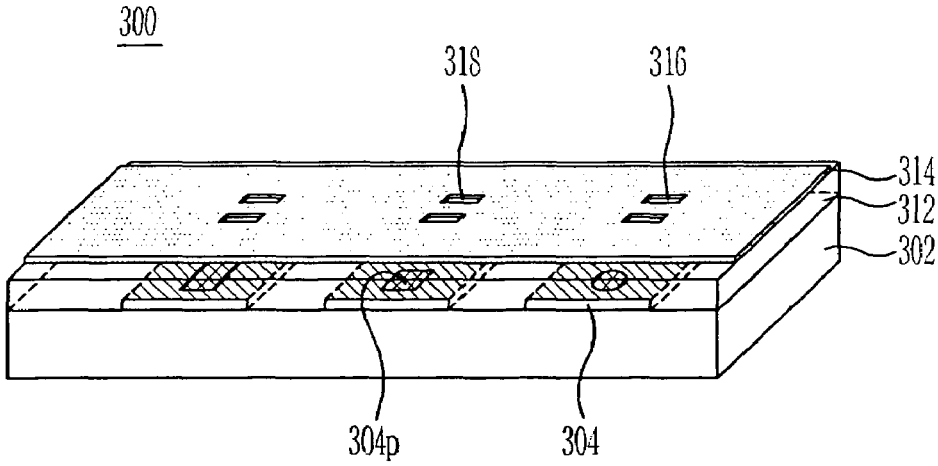
FIG. 2A is a perspective view of an electron emission device of an electron emission display having a triode top-gate structure according to an embodiment of the present invention.
Figure 2B:
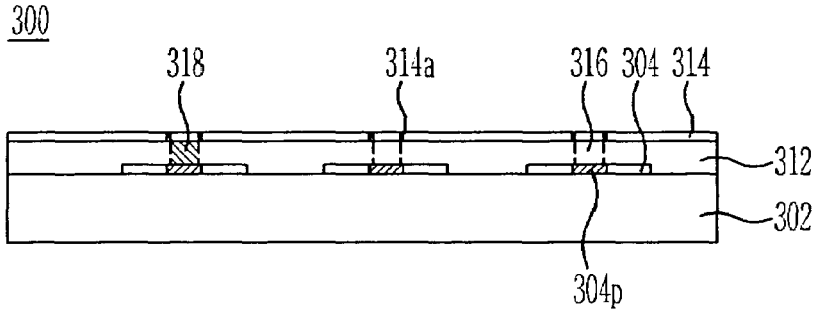
FIG. 2B is a sectional view of the electron emission device of FIG. 2A.

FIG. 2A is a perspective view of an electron emission device of an electron emission display having a triode top-gate structure according to the present invention and FIG. 2B is a sectional view of the electron emission device of FIG. 2A, wherein the hatching in FIG. 2B is not used to indicate a cross-section but rather to distinguish elements of the present invention.

Referring to FIGS. 2A and 2B, an electron emission device 300 comprises: a substrate 302; a first electrode 304 and a second electrode 314 formed on the substrate 302 with a predetermined shape and insulated from each other; and an electron emission region 318 connected to one of the first and second electrodes 304 and 314, wherein at least one of the first and second electrodes 304 and 314 is formed with a fine mesh pattern 304*p*. The fine mesh pattern 304*p* comprises at least one is of a plurality of apertures, a plurality of slits, and combinations thereof, through which light is transmitted.

In more detail, the cathode electrode 304 is made of a thin metal film. The cathode electrode 304 is disposed on an transparent optical substrate 302 and extended to have a stripe shape along a first direction. The cathode electrode 304 is employed as a data electrode to apply a data voltage to an electron emission region 318. Furthermore, the cathode electrode 304 is formed with a fine mesh pattern 304*p*. The fine mesh pattern 304*p* is formed in a region in which the stripe-like cathode electrode 304 crosses the stripe-like gate electrode 314 extended perpendicular to the stripe-like cathode electrode 304. The fine mesh pattern 304*p* indicates a structure in which a fine aperture or a fine slit forms a mesh shape to transmit light therethrough. Consequently, the cathode electrode 304 does not transmit the light itself but only transmits the light through the fine mesh pattern thereof.

The dielectric layer 312 covers both the stripe-like cathode electrode 304 and the transparent optical substrate 302 exposed between the cathode electrodes 304. An inexpensive soda-lime glass is employed as the transparent optical substrate 302.

The gate electrode 314 is disposed as a thin metal film on the dielectric layer 312. The gate electrode 314 is shaped like a stripe extended perpendicularly to the stripe-like cathode electrode 304. Furthermore, the gate electrode 314 is, as shown in FIG. 2B, formed with an opening 314*a*. Such an opening 314*a* is formed corresponding to a gate aperture 316 (to be described later). In more detail, the opening 314*a* is formed to be slightly larger than the gate aperture 316 when the gate electrode 314 is patterned to have the stripe shape after the etching process for the gate aperture 316.

The gate aperture 316 is formed on the cathode electrode 304. The gate aperture 316 is formed as a via-hole passing through the gate electrode 314 and the dielectric layer 312. Also, the gate aperture 316 is formed in the region in which the cathode electrode 304 crosses the gate electrode 314. Furthermore, the gate aperture 316 is formed above the fine mesh pattern 304*p*. Therefore, the fine mesh pattern 304*p* of the cathode electrode 304 is wholly or partially exposed through the gate aperture 316.

The electron emission region 318 is arranged inside the gate aperture 316 and connected to the cathode electrode 304. In more detail, the electron emission region 318 is in contact with the fine mesh pattern 304*p*. Furthermore, the electron emission region 318 is spaced a predetermined distance apart from the gate electrode 314. The electron emission region 318 emits electrons depending on an electric field due to the voltage supplied between the cathode electrode 304 and the gate electrode 314. Preferably, the electron emission region 318 comprises a nano-tube such as a Carbon Nano-Tube (CNT), a nano-wire, Silicon (Si), Silicon Carbide (SiC), graphite, diamond, Diamond-Like Carbon (DLC), or a combination thereof.

In FIG. 2A, a connection between the fine mesh pattern 304*p* and the electron emission region 318 is hidden behind the gate electrode 314 and is not illustrated, and thus only the fine mesh pattern 304*p* is illustrated as being disposed on the cathode electrode 304. Furthermore, in FIG. 2B, the electron emission region 318 is illustrated in only one of the three gate apertures 316.

Figure 3:
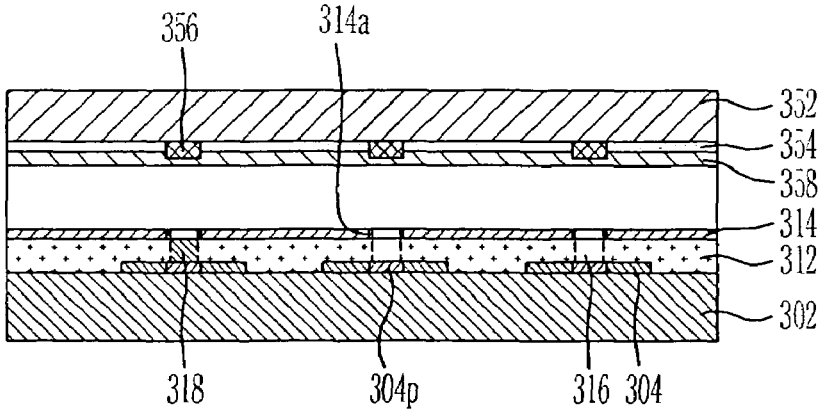
FIG. 3 is a sectional view of the electron emission display comprising the electron emission device of FIGS. 2A and 2B.

FIG. 3 is a sectional view of the electron emission display comprising the electron emission device of FIGS. 2A and 2B.

Referring to FIG. 3, an electron emission display comprises: a first substrate 302 and a second substrate 352 arranged opposite to each other; a first electrode 304 and a second electrode 314 formed on the first substrate 302 and insulated from each other; an electron emission region 318 connected to one of the first and second electrodes 304 and 314; and an image displaying portion comprising a fluorescent layer 356 and an anode electrode 358 formed on the second substrate 352, wherein at least one of the first and second electrodes 304 and 314 is formed with a fine mesh pattern. The fine mesh pattern 304*p* comprises at least one of a plurality of apertures, a plurality of slits, and a combination thereof, through which light is transmitted.

In more detail, the electron emission display comprises the first substrate 302 and the second substrate 352.

In the first substrate 302, a cathode electrode 304, having a predetermined pattern, e.g., a stripe pattern, is formed on an inner surface of the first substrate 302. A dielectric layer 312 is formed on the cathode electrode 304. A gate electrode 314 having a stripe shape situated transversely to the cathode electrode 304 is formed on the dielectric layer 312. The dielectric layer 312 on the cathode electrode 304 has an aperture 316. Portions of the cathode electrode 304 exposed through the aperture include an electron emission region 318 to emit electrons. The gate electrode 314 has an opening 314*a* corresponding to the aperture 316, so that the electrons emitted from the electron emission region 318 pass through the opening 314*a* and the aperture 316 and travel to the anode electrode 358. Additionally, the first substrate 302 and the second substrate 352 are spaced a predetermined distance apart by a spacer (not shown) arranged between the first substrate 302 and the second substrate 352.

In the second substrate 352, an anode electrode 358 covers the entire inner surface of the second substrate 352 to accelerate the electrons emitted by the electron emission region 318. Furthermore, a fluorescent layer 356 having a stripe shape is formed on the anode electrode 358 facing the cathode substrate 302. Additionally, an optical interception film can be formed between the fluorescent layers 356.

The electron emission region 318 comprises a nano-tube, such as a Carbon Nano-Tube (CNT), a nano-wire, Silicon (Si), Silicon Carbide (SiC), graphite, diamond, Diamond-Like Carbon (DLC), or a combination thereof.

Furthermore, a conductive metal mesh (not shown) is additionally provided in the gate electrode 314 to prevent an arc, thereby controlling electrons emitted from the electron emission region 318 between the gate electrode 314 and the anode electrode 358, and effectively focusing the electrons (i.e., an electron beam). Also, a metal reflecting film of a metal such as Aluminum (Al) can be additionally provided to enhance electron focusing efficiency and luminescence efficiency.

According to an embodiment of the present invention, the cathode electrode 304 comprises a metal electrode having the fine mesh pattern 304*p* instead of an ITO electrode having a high resistance. Hence, the resistance of the electrode is lowered, thereby increasing the brightness difference between the left and right sides and the difference in brightness between pixels.

A method of fabricating an electron emission device of an electron emission display according to an embodiment of the present invention is described below.

According to another aspect of the present invention, a method of fabricating the electron emission device comprises: forming a first electrode 304 having a fine mesh pattern 304*p* on a transparent optical substrate 302; forming a dielectric layer 312 having an aperture 316 through which the fine mesh pattern 304*p* is exposed and covering the substrate 302 and the first electrode 304; forming a second electrode 314 having an opening 314*a* corresponding to the aperture 316 on the dielectric layer 312; and forming an electron emission region 318 within the aperture 316 to be connected to the fine mesh pattern 304*p*. The first electrode 304 comprises a conductive metal selected from at least one of gold (Au), silver (Ag), platinum (Pt), aluminum (Al), chrome (Cr), or an alloy thereof.

FIGS. 4A through 4H are views of a method of fabricating an electron emission device of an electron emission display according to an embodiment of the present invention.

Figure 4A:
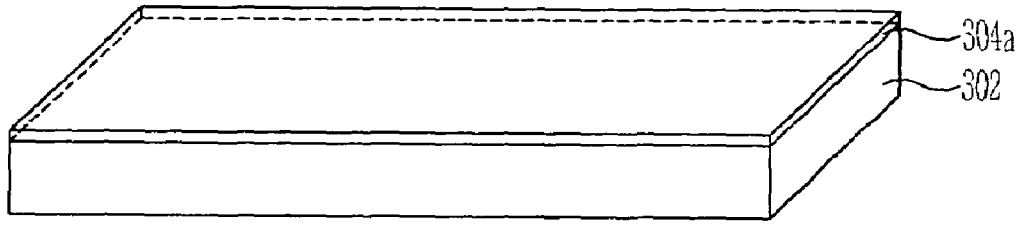
FIGS. 4A through 4H are views of a method of fabricating the electron emission device of the electron emission display according to an embodiment of the present invention.

Referring to FIG. 4A, a soda-lime glass substrate 302 is first provided to fabricate the cathode substrate. Then, a cathode metal layer 304*a* is deposited on the entire area of a glass substrate 302. Various deposition methods, such as a sputtering, etc. can be used for depositing the cathode metal layer 304*a*. According to an embodiment of the present invention, the cathode metal layer 304*a* is employed in lieu of the ITO electrode layer used in conventional fabricating methods.

Figure 4B:
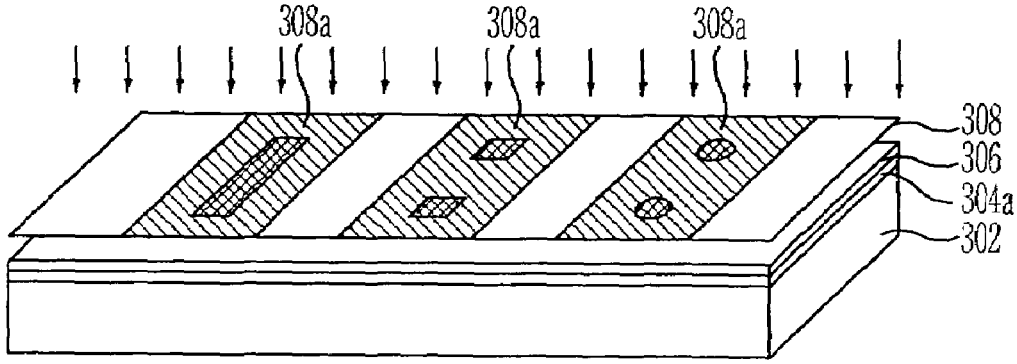

Referring to FIG. 4B, the cathode metal layer 304*a* is patterned to have a fine mesh pattern. To this end, a photosensitive layer 306 is first formed on the cathode metal layer 304*a*, wherein the photosensitive layer 306 includes a photoresist. Then, the photosensitive layer 306 is processed by exposure and development through a mask 308 formed with a cathode electrode pattern 308*a* so as to be used as a mask (not shown) for etching the cathode metal layer 304*a*.

Figure 4C:
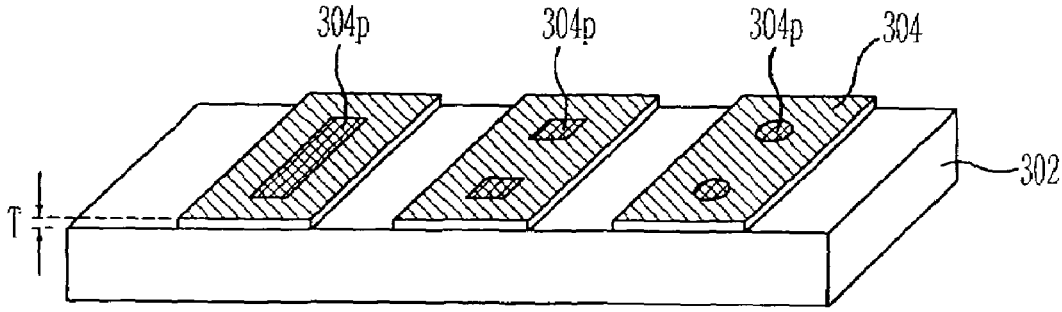

Referring to FIG. 4C, the cathode metal layer 304*a* is formed as a cathode electrode 304 having the fine mesh pattern 304*p* by the foregoing cathode patterning process. The fine mesh pattern 304*p* indicates a pattern structure which can transmit light. For example, the light-transmissive pattern structure includes a thin metal film structure formed with a plurality of apertures having a circular or polygonal shape. Furthermore, the light-transmissive pattern structure includes a thin metal film structure formed with a plurality of slits or slots having a circular or polygonal shape.

Figure 5:
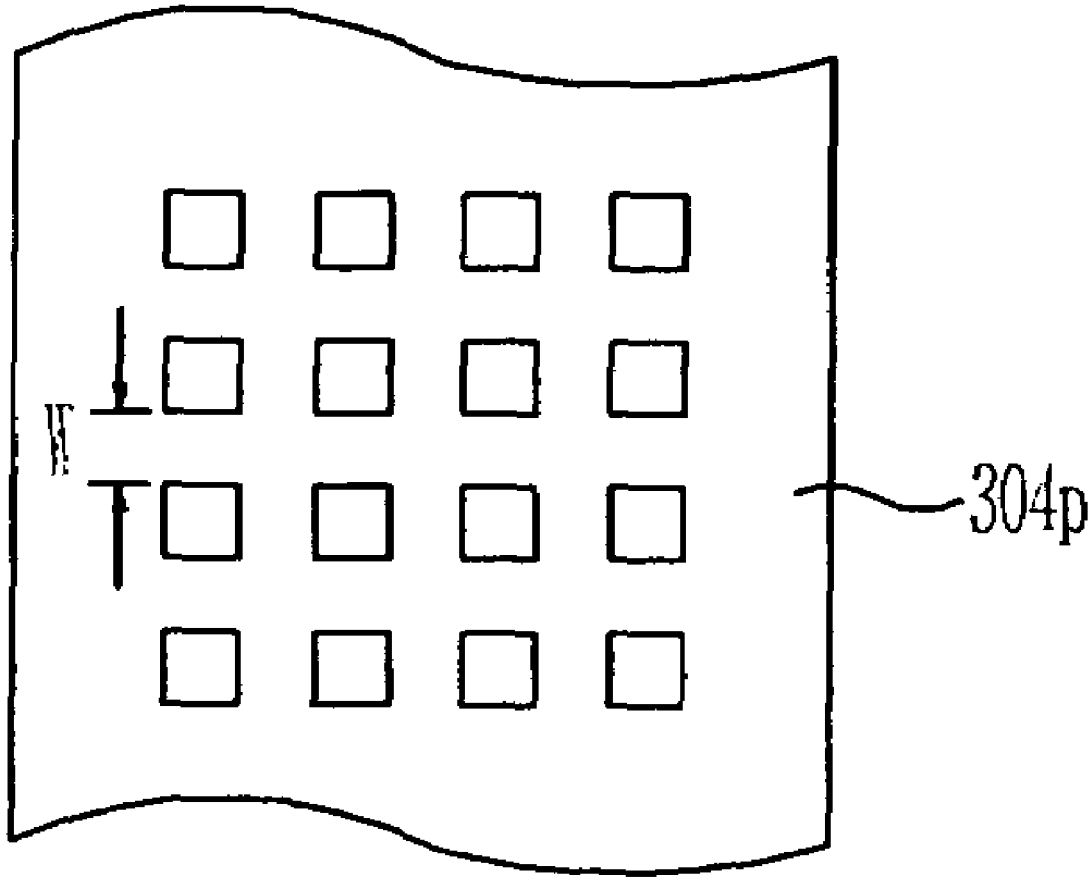
FIG. 5 is a view of a fine mesh pattern according to an embodiment of the present invention.

The shape of the fine mesh pattern 304*p* can vary corresponding to the shape of the electron emission region connected to the fine mesh pattern 304*p*. In this embodiment, the fine mesh pattern 304*p* is, as depicted in FIG. 4C, approximately shaped like a rectangle, a square and a circle. Furthermore, as shown in FIGS. 4C and 5, the thickness of the fine mesh pattern 304*p* and the width between the fine mesh patterns 304*p* are determined by the electrode resistance of the cathode electrode. For instance, the thickness and the width are preferably determined to allow the cathode electrode to have an electrode resistance of about 5KO in the case of a 38 inch electron emission display.

Figure 4D:
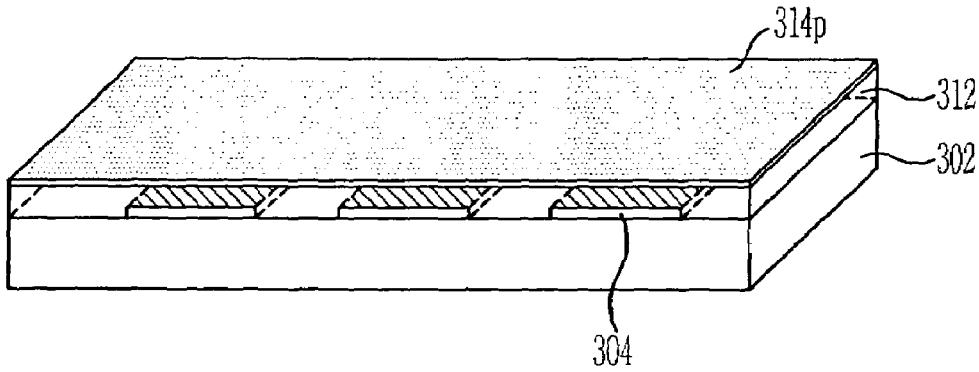

Referring to FIG. 4D, the dielectric layer 312 is first applied to the entire area, covering both the cathode electrode 304 having the fine mesh pattern 304*p* and the glass substrate 302 exposed between the cathode electrodes 304. Such a dielectric layer 312 is formed as a thick film by a screen-printing method and is then dried and annealed. Thereafter, a gate electrode layer 314*p* is deposited on the entire area of the dielectric layer 312. The gate electrode layer 314*p* can be printed by way of example by the sputtering method using chrome (Cr).

Figure 4E:
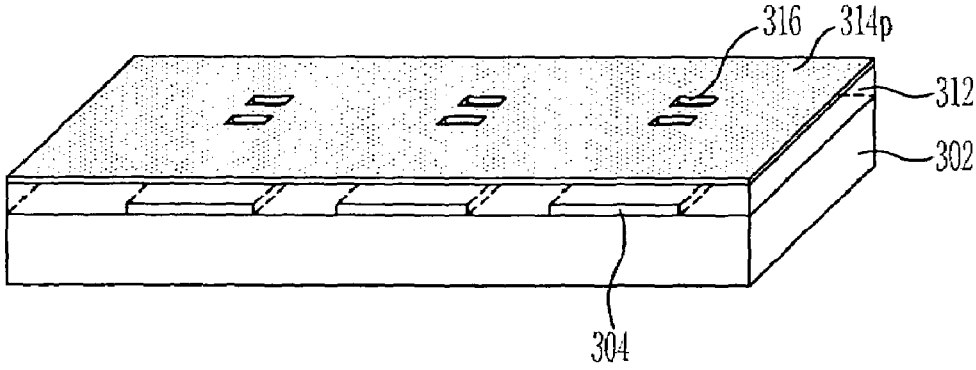

Referring to FIG. 4E, a gate aperture 316 is formed above the cathode electrode 304. Therefore, the fine mesh pattern of the cathode electrode 304 is exposed through the gate aperture 316. To this end, the photosensitive layer (not shown) is formed by coating the gate electrode layer 314*p* with the photoresist. Then, the photosensitive layer is processed by exposure and development so as to be used as a mask having a gate aperture pattern. On the basis of the gate aperture pattern of the mask, the gate electrode layer 314*p* and the dielectric layer 312 are etched in sequence. The gate electrode layer 314*p* is etched prior to the dielectric layer 312, thereby functioning as an etching mask of the dielectric layer 312. Thus, the gate aperture 316 is formed by the foregoing processes. After forming the gate aperture 316, the photoresist is removed.

Figure 4F:
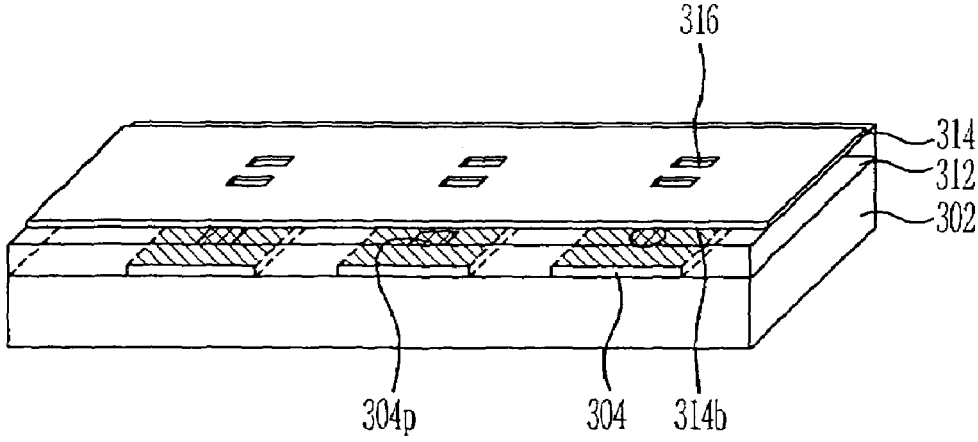

Referring to FIG. 4F, the gate electrode layer 314*p* is patterned as a stripe-like gate electrode 314. To this end, the entire area of the gate electrode 314*p* is first coated with a photosensitive layer (not shown). The photosensitive layer is processed by exposure and development so as to be used as a mask having a gate electrode pattern 314*b*. On the basis of the gate electrode pattern 314*b* of the mask, the gate electrode layer 314*p* is etched as the stripe-like gate electrode 314. The gate electrode 314 is patterned to have an opening which, as illustrated in FIG. 2B, is larger than the gate aperture 316. After forming the gate electrode 314, the photoresist is removed.

Figure 4G:
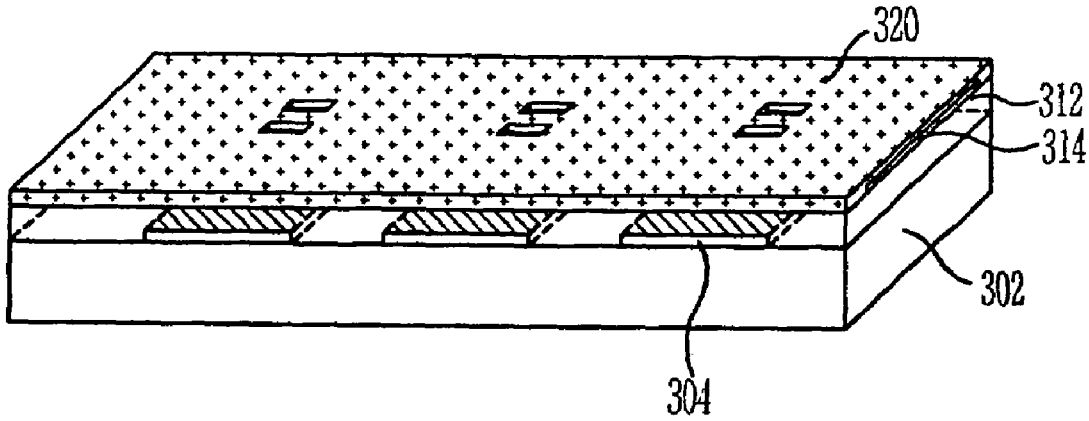

Referring to FIG. 4G, a photosensitive sacrificial layer 320 is applied to the entire area of the glass substrate 302 having the gate electrode 314. The sacrificial layer 320 is processed by exposure and development, thereby exposing a region of the cathode electrode 304 having with the electron emission region inside the gate aperture.

Figure 4H:
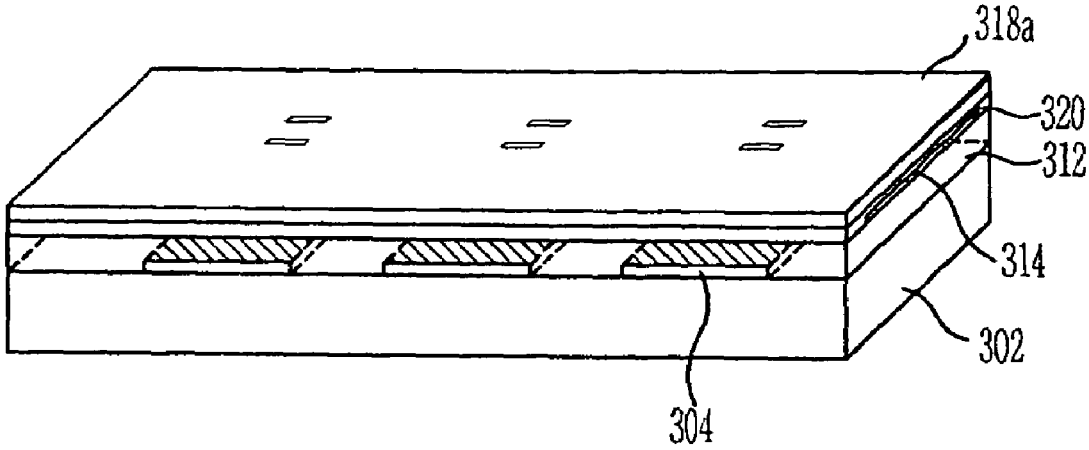

Referring to FIG. 4H, an electron emission region paste 318*a* is applied to the entire area of the sacrificial layer 320 so as to form the electron emission region. The electron emission region paste 318*a* is printed as a thick film by a screen-printing method and is then dried. The electron emission region paste 318*a* is formed inside the gate aperture, that is, filled in the gate aperture above the fine mesh pattern of the cathode electrode 304 exposed through the gate aperture. Thereafter, the electron emission region paste 318*a* is processed by a rear exposure using scattered light and development, thereby forming the electron emission region. With this process, the cathode substrate of the electron emission display having a top-gate structure is as shown in FIG. 3, wherein the cathode substrate employs the thin metal film electrode as the data electrode.

As described above, according to the present invention, an electron emission device of an electron emission display employs a thin metal film electrode instead of an ITO electrode, so that the electrode resistance is decreased as compared to when the ITO electrode is used, thereby allowing the electron emission display to consume relatively low power. Also, it is possible to obtain a relatively thin cathode electrode.

Furthermore, according to the present invention, a thin metal film electrode instead of an ITO electrode is employed as a data electrode, so that it is possible to use an inexpensive glass substrate, thereby reducing the production cost of an electron emission display.

Although exemplary embodiments of the present invention have been shown and described, it would be appreciated by those skilled in the art that modifications can be made to these embodiments without departing from the principles and spirit of the present invention, the scope of which being defined by the following claims.

What is claimed is:

1. An electron emission device comprising: a substrate; a first electrode disposed on the substrate, the first electrode having a fine mesh pattern arranged within a first aperture in the first electrode; a dielectric layer having a second aperture through which the fine mesh pattern is exposed, the dielectric layer covering the substrate and the first electrode; a second electrode disposed on the dielectric layer, the second electrode having an opening corresponding to the second aperture; and an electron emission region disposed within the second aperture, the electron emission region being directly connected to the fine mesh pattern, wherein the fine mesh pattern being arranged between the substrate and the electron emission region.

2. The electron emission device according to claim 1, wherein the fine mesh pattern transmits light therethrough and comprises at least one of a plurality of apertures, a plurality of slits, and a combination thereof.

3. The electron emission device according to claim 1, wherein the fine mesh pattern is arranged in correspondence with the electron emission region.

4. The electron emission device according to claim 1, wherein the thickness and the width of the fine mesh pattern are in accordance with the resistance of the first electrodes.

5. The electron emission device according to claim 1, further comprising a grid electrode adapted to focus electrons emitted by the electron emission region.

6. The electron emission device according to claim 1, wherein the electron emission region comprises a nano-tube including one of a Carbon Nano-Tube (CNT), a nano-wire, Silicon (Si), Silicon Carbide (SiC), graphite, diamond, Diamond-Like Carbon (DLC), or a combination thereof.

7. An electron emission display comprising: a first substrate and a second substrate arranged opposite to each other, the first substrate being a transparent optical substrate; a first electrode disposed on the first substrate, the first electrode having a fine mesh pattern arranged within a first aperture in the first electrode; a dielectric layer having a second aperture through which the fine mesh pattern is exposed, the dielectric layer covering the first substrate and the first electrode; a second electrode disposed on the dielectric layer, the second electrode having an opening corresponding to the second aperture; and an electron emission region disposed within the second aperture, the electron emission region being directly connected to the fine mesh pattern; and an image displaying portion including an anode electrode and a fluorescent layer arranged on the second substrate, wherein the fine mesh pattern being arranged between the substrate and the electron emission region.

8. The electron emission display according to claim 7, wherein the fine mesh pattern transmits light therethrough and comprises at least one of a plurality of apertures, a plurality of slits, and a combination thereof.

9. The electron emission display according to claim 7, wherein the fine mesh pattern is arranged in correspondence to the electron emission region.

10. The electron emission display according to claim 7, wherein the thickness and the width of the fine mesh pattern are in accordance with the resistance of the at least one of the first and second electrodes having the fine mesh pattern.

11. The electron emission device according to claim 7, wherein the electron emission region comprises a nano-tube including one of a Carbon Nano-Tube (CNT), a nano-wire, Silicon (Si), Silicon Carbide (SiC), graphite, diamond, Diamond-Like Carbon (DLC), or a combination thereof.

12. The electron emission display according to claim 7, further comprising a grid electrode adapted to focus electrons emitted by the electron emission region.

13. The electron emission display according to claim 7, further comprising an optical interception film arranged on an inner surface of the second substrate facing the first substrate.

14. The electron emission display according to claim 7, further comprising a metal reflecting film arranged on an inner surface of the second substrate facing the first substrate.

15. The electron emission display according to claim 7, further comprising a spacer adapted to support the first and second substrates to space them apart from each other.

16. A method of fabricating an electron emission device, the method comprising: forming a first electrode on a transparent optical substrate, the first electrode having a fine mesh pattern arranged within a first aperture in the first electrode; forming a dielectric layer having a second aperture through which the fine mesh pattern is exposed, the dielectric layer covering the transparent optical substrate and the first electrode; forming a second electrode on the dielectric layer, the second electrode having an opening corresponding to the second aperture; and forming an electron emission region within the second aperture, the electron emission region being directly connected to the fine mesh pattern, wherein the fine mesh pattern being arranged between the substrate and the electron emission region.

17. The method according to claim 16, wherein forming the first electrode comprises forming the fine mesh pattern to include at least one of a plurality of apertures, a plurality of slits, and a combination thereof, through which light is transmitted.

18. The method according to claim 16, wherein the first electrode comprises a conductive metal selected from at least one of gold (Au), silver (Ag), platinum (Pt), aluminum (Al), chrome (Cr), and an alloy thereof.

19. The method according to claim 16, wherein forming the electron emission region comprises applying a carbon nano-tube paste to the substrate, processing the carbon nano-tube paste by rear exposure, and developing an unexposed portion of the carbon nano-tube paste.

20. The method according to claim 16, further comprising:

arranging said electron emission region on the transparent optical substrate;

forming a second substrate opposite to said transparent optical substrate;

forming a spacer to support the first and second substrates to space them apart from each other; and forming an image displaying portion including an anode electrode and a fluorescent layer arranged on the second substrate.

* * * * *